United States Patent [19]

Casey

[11] Patent Number: 4,995,821

[45] Date of Patent: Feb. 26, 1991

[54] MODULE RETENTION/EJECTION SYSTEM

[75] Inventor: Daniel T. Casey, Harrisburg, Pa.

[73] Assignee: AMP Incorporated, Harrisburg, Pa.

[21] Appl. No.: 510,371

[22] Filed: Apr. 17, 1990

[51] Int. Cl.[5] ..... H01R 13/62

[52] U.S. Cl. ..... 439/157; 439/540; 439/372

[58] Field of Search ..... 439/152–160, 439/372, 544, 550, 562, 563

[56] References Cited

U.S. PATENT DOCUMENTS

| | | | |
|---|---|---|---|
| 2,993,187 | 7/1961 | Bisbing et al. | 439/157 |
| 3,271,626 | 9/1966 | Howrilka | 439/152 |
| 3,360,689 | 12/1967 | Haury | 439/152 |
| 3,559,813 | 2/1971 | Sosinski | 211/89 |
| 3,570,096 | 3/1971 | Sosinski | 29/203 |
| 3,767,974 | 10/1973 | Donovan et al. | 439/153 |
| 3,824,525 | 7/1974 | Keller | 339/91 R |
| 3,993,390 | 11/1976 | Eigenbrode | 339/91 R |
| 4,070,081 | 1/1978 | Takahashi | 339/91 R |
| 4,168,877 | 9/1979 | Little et al. | 339/103 M |
| 4,241,966 | 12/1980 | Gomez | 339/45 M |
| 4,445,740 | 5/1984 | Wallace | 439/152 |
| 4,521,063 | 6/1985 | Milc | 439/152 |
| 4,648,009 | 3/1987 | Beun et al. | 361/399 |
| 4,735,583 | 4/1988 | Rudy, Jr. et al. | 439/350 |
| 4,778,411 | 10/1988 | Rudy, Jr. et al. | 439/681 |
| 4,864,721 | 9/1989 | Rudy, Jr. et al. | 29/825 |

OTHER PUBLICATIONS

Two photographs of product of Arizona Integrated Electronics Inc., Tempe, Ariz.

*Primary Examiner*—David L. Pirlot
*Attorney, Agent, or Firm*—Anton P. Ness

[57] ABSTRACT

A system for latching a plurality of connector modules (22) or multimodule units (18,20) in an array (10) to a panel (14) includes opposing parallel assemblies (30,32) mounted to the panel and each having a plurality of cam levers (34) in associated opposing pairs at each module site, each mounted along respective shafts (38) of the assemblies and adapted to be reciprocally rotatable about the shaft (38) outwardly from and inwardly toward the array. Each cam lever (34) includes a recess (68) into which a latching projection (100) of a module is receivable upon module insertion into the array, which when cam lever (34) is rotated inwardly urges the module into fully mated position in its receptacle connector (12), and which raises the projection (100) when the cam lever (34) is rotated outwardly, ejecting the module (22) from the receptacle connector (12). Several cam levers (34) can be ganged together to be rotatable outwardly as a unit, corresponding to several modules ganged as a unit (18,20). Unactuated cam levers retain their associated modules latched in fully mated positions.

11 Claims, 6 Drawing Sheets

MODULE RETENTION/EJECTION SYSTEM

FIELD OF THE INVENTION

This relates to the field of electrical connectors and more particularly to systems for retaining and selectively ejecting electrical connector modules of arrays.

BACKGROUND OF THE INVENTION

Arrays of electrical connectors are utilized in electronics bays of aircraft for example for integrating the wiring throughout all of the electrical systems of the aircraft including power, control, detection, indication, radio reception and transmission and so on, and for interconnecting such systems with each other and especially with black boxes for controlling or sensing. Cables of electrical conductors extend from such systems to the electronics bay in bundles or harnesses terminated thereat by electrical connectors matable with corresponding connectors in banks or arrays in a wire integration panel at the electronics bay. As disclosed in U.S. Pat. Nos. 4,735,583; 4,778,411 and 4,864,721 for example such electrical connectors may be single row modular plug connectors matable with modular receptacle connectors mounted on the panel. Typically the plug modules may be arranged in sets of two or five to be handled as a unit defining two or five rows of electrical contacts, and matable with corresponding receptacle connectors in the array having two or five rows of matable contacts. Each of the rows of contacts includes a keying system for physically encoding the row so that only the appropriate plug module can be inserted in the appropriate row of the receptacle connector.

Mating connectors typically have a means for fastening themselves together upon being mated, such as by integral latches or by spring clips as in U.S. Pat. No. 4,735,583. Especially in high vibration environments such as aircraft it is generally desirable for each module to include such a latch at each end to retain itself mated to the receptacle connector, or where the modules are ganged together for the multi-module unit to be latched to the receptacle connector at a plurality of locations at each end for vibration resistance, to assure that the connectors remain fully mated at all contact locations.

It is desirable for the means latching a module or multi-module unit to be easily delatched at both ends simultaneously for removal such as during repair or servicing.

It is further desirable for the means latching a multi-module unit to a receptacle connector to enable quick delatching for unmating the connectors, thus not requiring individual delatching of the latches at each of the multiple sites along each end.

It is also desirable for the means latching the modules and multi-module units in the receptacle connectors of an array to remain latched at all latch sites while permitting easy delatching of only selected sites, thus assuring that all nearby connectors remain mated while the selected module or multi-module unit is removed such as for repair of servicing.

It is yet further desirable for the latching means to define a low profile permitting bundles of conductors to be routed close the the connector array for dense packing of multiple connector arrays in an electronics bay, and also not obstruct access to or removal and replacement of connectors of an array.

It is similarly desirable for the latching means to define a narrow profile permitting dense packing of adjacent connector arrays.

It is also further desirable for the latching means to include means for ejecting a module or multi-module unit from the receptacle connector at least a certain distance to enable manual or tool-assisted gripping of the module or multi-module unit from amid the adjacent modules closely spaced therefrom, for complete removal from the array.

It is additionally desirable for the latching means to be rugged and durable.

SUMMARY OF THE INVENTION

The present invention is a system for retaining a plurality of plug connector modules or multi-module units in an assured mated condition with corresponding receptacle connectors mounted side-by-side in an aligned array on a panel and for selectively ejecting a module or unit from such mated condition. A pair of retention/ejection assemblies are mounted to the panel each along and adjacent to a respective side of the array of receptacle connectors. Each assembly includes a plurality of cam levers extending along a common shaft mounted to a base member secured to the panel along the side of the array, a cam lever being located at each respective latching site. Each cam lever is reciprocally rotatable about the shaft inwardly toward and outwardly away from the receptacle connector array between first and second positions. Both assemblies are programmed to match the array of plug modules and correspond to the multi-module units, by the free ends of the appropriate number of adjacent cam levers being ganged appropriately by a pin of appropriate length fastened through aligned holes therethrough to act as a single cam lever unit.

Each cam lever includes a recess adjacent a projection outwardly from the side surface of a plug module or multi-module unit when inserted into a receptacle connector, to latch the module or unit in a fully mated condition in the receptacle connector. Projections are disposed at each end of a module and multi-module unit and each defines a respective ledge-like upwardly facing retention surface cooperable with a corresponding downwardly facing surface defined by the top of the recess of the cam lever. The projection can be a separate member secured along a side face of a plug module; the separate member can further have a length corresponding to the number of modules being ganged together and be fastenable to each of the modules thereof and thus serve as the means securing or ganging the plug modules together.

When the respective pair of opposed cam levers or cam lever units are rotated to their second or outward positions, the plug module or multi-module unit is inserted between the cam levers or units until the projections are within the respective recesses and resting on the lower recess surfaces. Then the cam levers or units are rotated inwardly, and the upper recess surfaces engage the upper projection surfaces and urge the plug module or unit downwardly a limited additional distance into a fully mated position with the corresponding receptacle connector. A locking plate may be secured to each base member to extend along outer surfaces of the cam levers of each assembly after all plug modules or units have been fully mated, positively securing all plug modules in the array for in-service use.

During actuation of the cam levers to eject a selected module or multi-module unit, an outward end of a cam lever or ganged cam lever unit is rotated outwardly from the side of the array which rotates the detent or recesses upwardly so that their bottom surfaces urge upwardly the projection by engaging a downwardly facing surface thereof, thereby lifting or ejecting a module or multi-module unit from the receptacle connector. During the removal or ejection of the selected plug module or unit from its receptacle connector, the other plug modules or units remain secured in their mated condition by the other cam levers or cam lever units which remain unaffected by the actuation of the selected cam lever or cam lever unit.

It is an objective of the present invention to provide a retention/ejection system separate from but cooperable with mating plug and receptacle connectors of a panel-mounted for retaining the connectors in mated condition while permitting selective removal of a plug from a receptacle of the array.

It is another objective to provide for easy actuation of the retention/ejection system for ejection of a selected plug when desired which system otherwise retains the mated connectors assuredly mated in a high vibration environment.

It is also an objective such a system which is programmable to permit actuation of several cam levers thereof as a unit during mating and removing of a multi-module plug connector unit from a corresponding receptacle connector.

It is an additional objective to provide such a programmable retention/ejection system which has a low and narrow profile to be suitable in a crowded electronics bay having many connector arrays, array panels and conductor bundles densely packed.

It is a further objective to provide such a system which is durable and rugged.

Embodiments of the present invention will now be described with reference to the accompanying drawings.

DETAILED DESCRIPTION OF THE PREFERRED EMBODIMENTS

Figure 1:
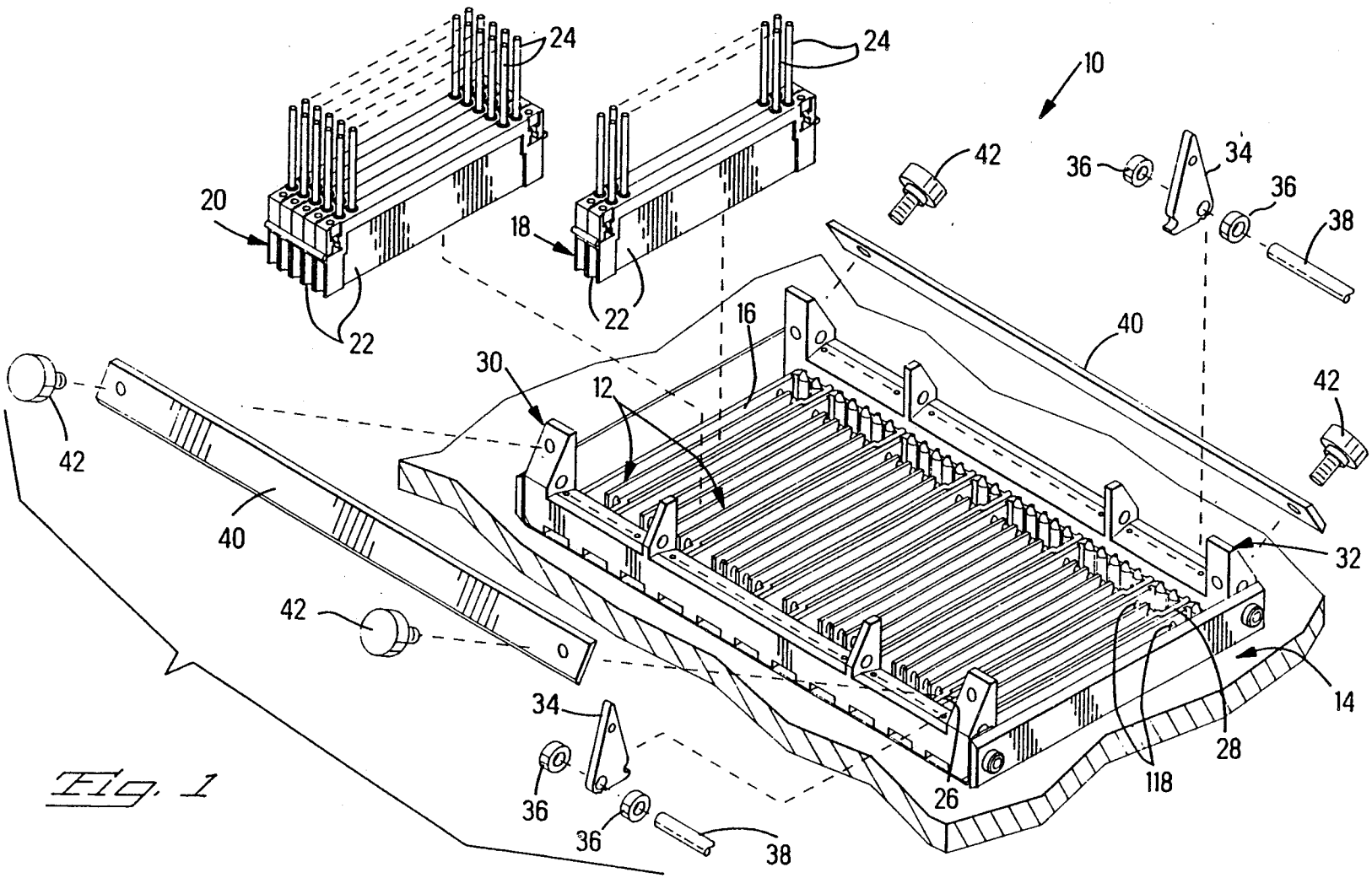
FIG. 1 is an isometric view showing a panel-mounted array of receptacle connectors and representative mating plug modules and multi-module units exploded therefrom, and a representative cam lever and shaft and locking member exploded from the retention/ejection assemblies along each side of the array.

In FIG. 1 a connector array 10 includes a plurality of receptacle connectors 12 mounted to a panel 14 in a large cutout 16 thereof. Plug connectors are represented by a two-module plug unit 18 and five-module plug unit 20, each plug module 22 thereof being a single-row connector for terminating a single row of conductors 24. Mounted to panel 14 along a first side 26 of array 10 is a retention/ejection assembly 30 of the present invention, while shown mounted to panel 14 along the opposed side 28 for an opposed assembly 32 of the present invention, with a representative cam lever 34 and associated spacers 36 exploded from a shaft 38. Also seen are locking plates 40 fastenable to the assemblies 30,32 by hand-rotatable screws 42 to secure the cam levers 34 in their retention positions about shafts 38 in order to maintain the plug modules or units assuredly latched in mated condition with the receptacle connectors during substantial vibration over extended in-service use.

Figure 2:
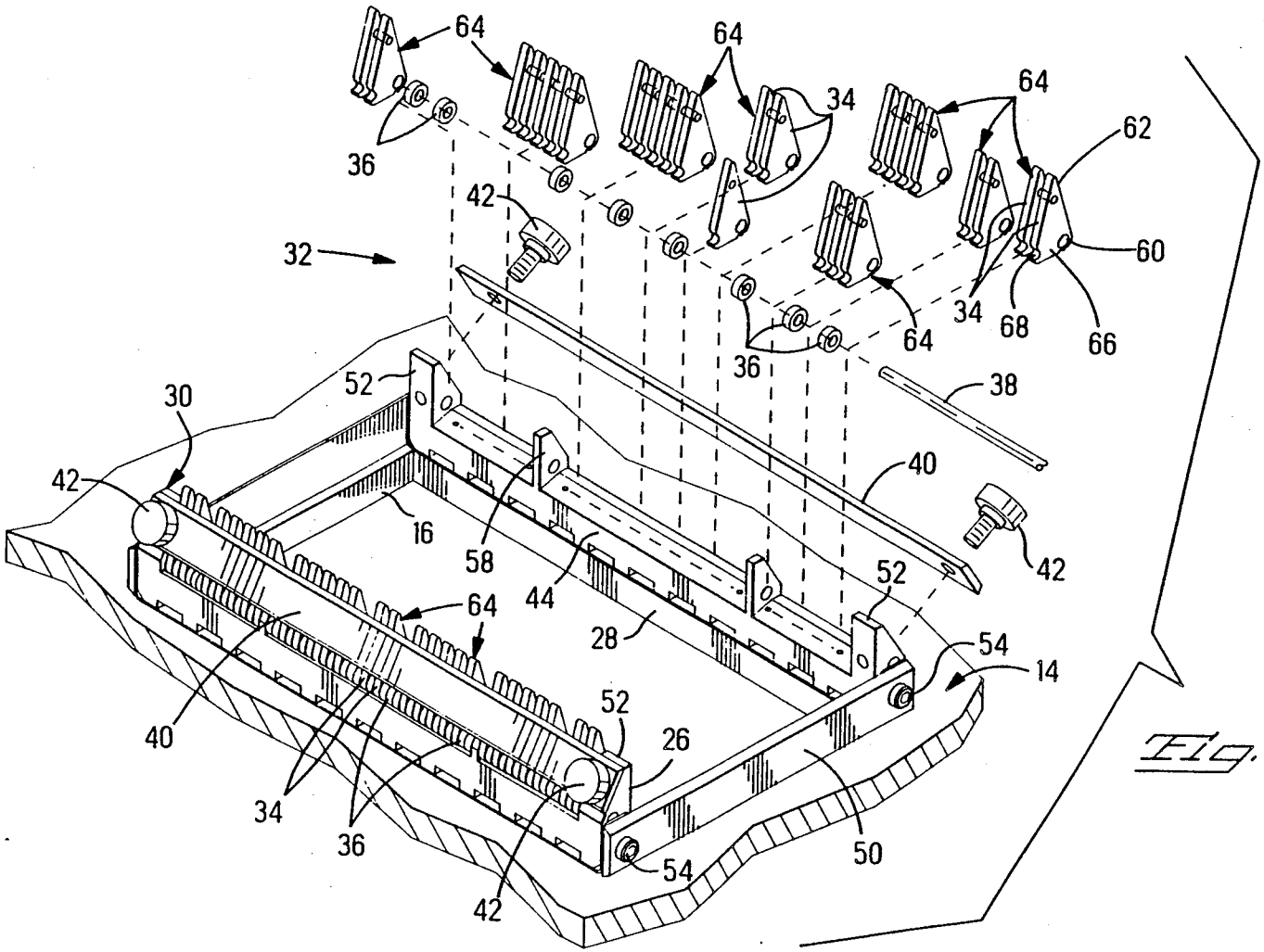
FIGURE 2 is an isometric view of the panel-mounted retention/ejection assemblies of FIG. 1, with the cam levers and cam lever units exploded from one of the assemblies and assembled in the other.
Figure 3:
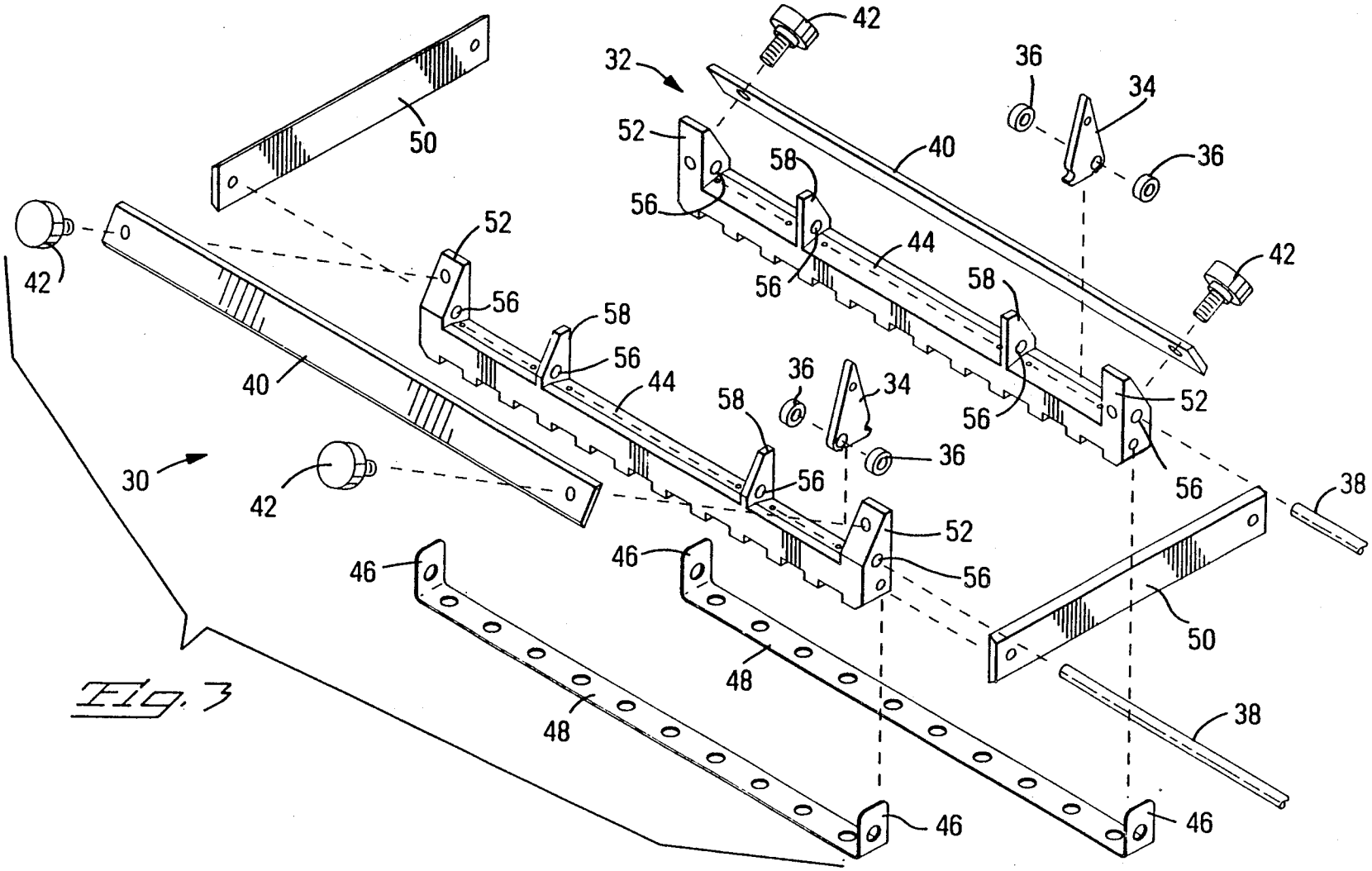
FIG. 3 is an exploded isometric view of the assemblies of FIG. 2 with a representative cam lever exploded from each assembly.

Referring to FIGS. 2 and 3, each assembly 30,32 includes an integral base member 44 mounted between ends 46 of a bracket member 48 secured to panel 14 using end members 50 extending between ends 52 of both respective assemblies 30,32 and using bolts 54 fastening both base member 44 and end member 50 to a bracket end 46. Shaft 38 of each assembly 30,32 extends through aligned holes 56 of each end section 52 of base member 44, and through each intermediate flange section 58. A respective cam lever 34 is mounted in each assembly 30,32 to correspond with each plug module site of a receptacle connector 12 of FIG. 1, and is shaped and dimensioned appropriately and spaced from adjacent cam levers by spacers 36. Each cam lever 34 includes a shaft-receiving aperture 60 therethrough through which shaft 38 extends, securing cam lever 34 to the assembly in a manner permitting rotation of cam lever 34 about shaft 38 between a first or retention position for holding a corresponding plug module in mated condition with a receptacle connector, and a second or actuated position ejecting such plug module from the connector. Shaft members 38 and bracket members 48 are preferably stainless steel, and cam levers 34 are preferably aluminum and may optionally be wear-resistant plastic. Base members 44 may be of aluminum.

Each cam lever 34 extends upwardly to a free end 62 outwardly above shaft 38. Free end 62 is engageable by hand to actuate the cam lever when desired to rotate the free end 62 outwardly about shaft 38 and away from a side of a corresponding plug module 22 for ejection thereof. One or more adjacent cam levers can be secured together at free ends 62 to gang them together as desired to comprise a multi-lever unit 64 maneuverable as a unit for actuation for ejection of a corresponding multi-module unit such as units 18, 20 of FIG. 1. Each cam lever 34 also includes a lower lobe 66 adjacent shaft aperture 60 extending inwardly therefrom toward a side surface of a respective plug module 22 in a fully assembled connector array. The plug-facing surface of lobe 66 is spaced a selected distance inwardly from shaft-receiving aperture 60 and includes a projection-receiving recess 68 thereinto. The structure of a cam lever unit 64 is explained in greater detail with reference to FIG. 6.

Figure 4A:
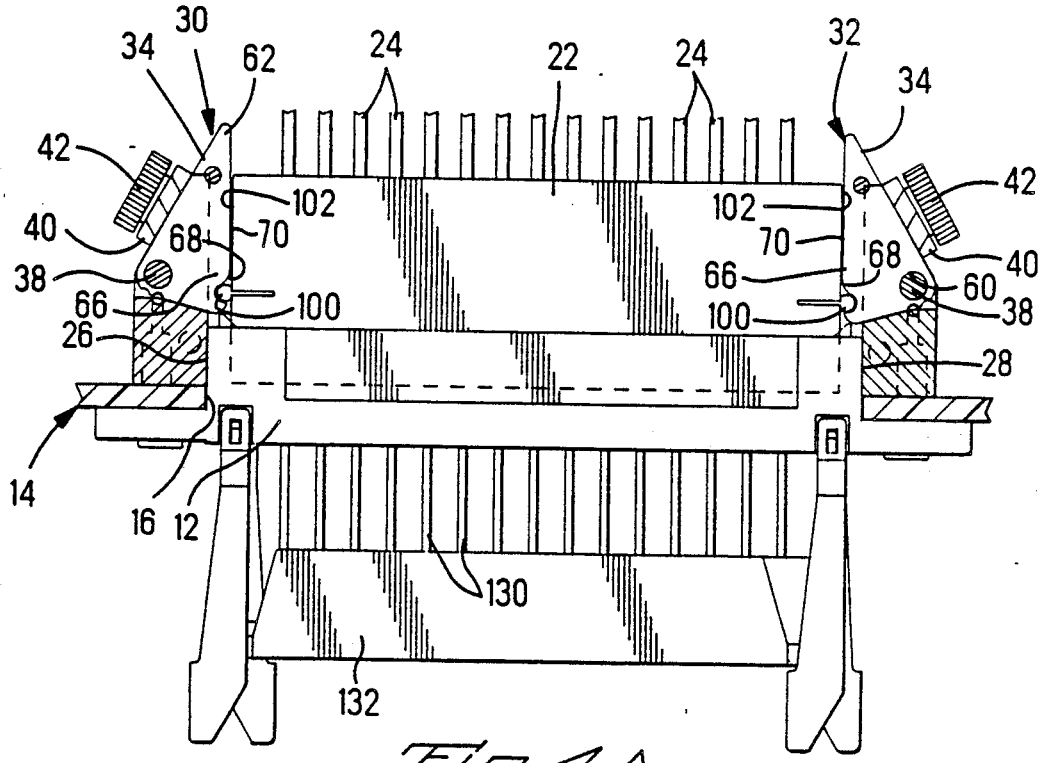
FIGS. 4A and 4B demonstrate actuation of the retention/ejection system of FIGS. 1 to 3 showing a plug module fully latched and retained in mated condition with a receptacle connector in FIG. 4A, and the opposed cam levers actuated by being rotated outwardly thereby ejecting the plug module from the receptacle connector for removal thereof from the connector.

The functioning of cam levers 34 with respect to retention and ejection of plug modules 22 is explained with reference to FIGS. 4A to 5B. In FIGS. 4A and 5A a plug module 22 is shown latched in a fully mated condition with a receptacle connector 12 mounted in cutout 16 to panel 14. Cam levers 34 and cam lever units 64 are associated in opposing pairs with respective plug modules 22 and multi-module units 18,20 respectively. Projection-receiving recess 68 of cam lever 34 extends into module-proximate surface 70 of lobe 66 and is adapted for receiving thereinto a projection 100 extending outwardly from a side surface 102 of a plug module 22. Upper surface 72 of recess 68 engages upwardly facing surface 104 of projection 100 to hold plug module 22 downwardly in a fully mated relationship with its receptacle connector 12, as in FIGS. 4A and 5A. Locking plate 40 extends across outer surfaces 74 of all cam levers 34 of a respective assembly 30,32 and holds them in their first or retention positions about shaft 38, assuring that all plug modules 22 or multi-module units 18,20 of the array are secured in mated relationship with respective receptacle connectors 12 during in-service use, capable of withstanding substantial levels of vibration. An array of wire wrap post terminals 130 is shown extending below receptacle connector 12 for electrical interconnection to those of other connectors as desired; secured over the posts is a removable post protector 132 latched to receptacle connector 12.

Figure 4B:
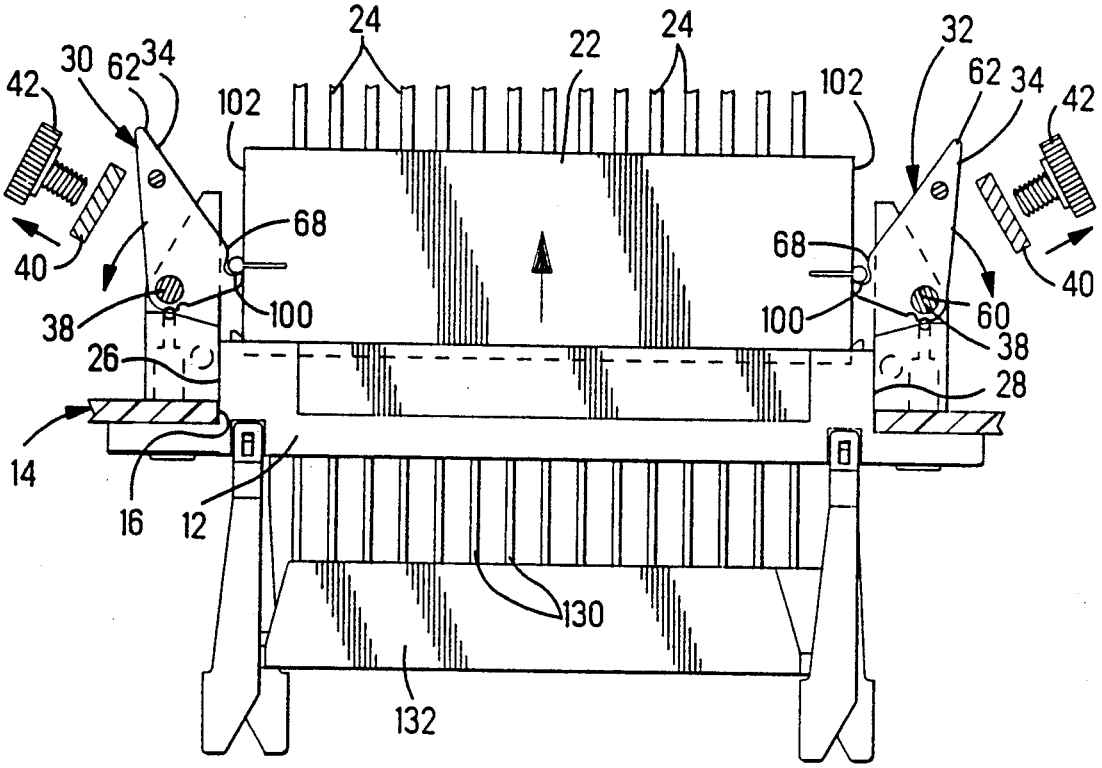
Figure 5A:
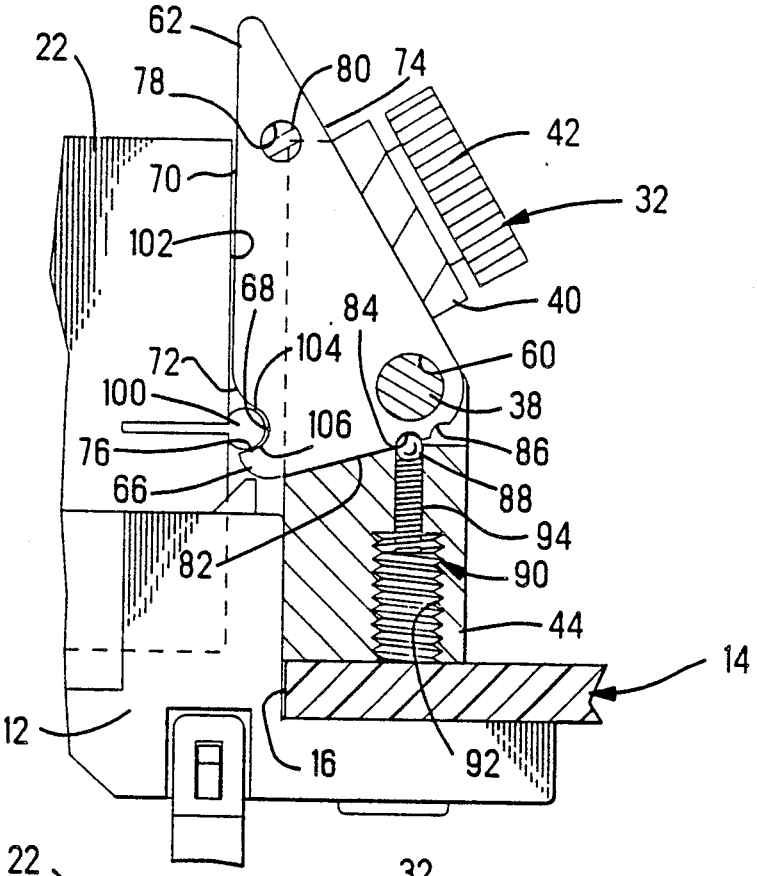
FIGS. 5A and 5B are enlarged views of a latching site of one end of a plug module, before and after cam lever actuation, corresponding to FIGS. 4A and 4B.
Figure 5B:
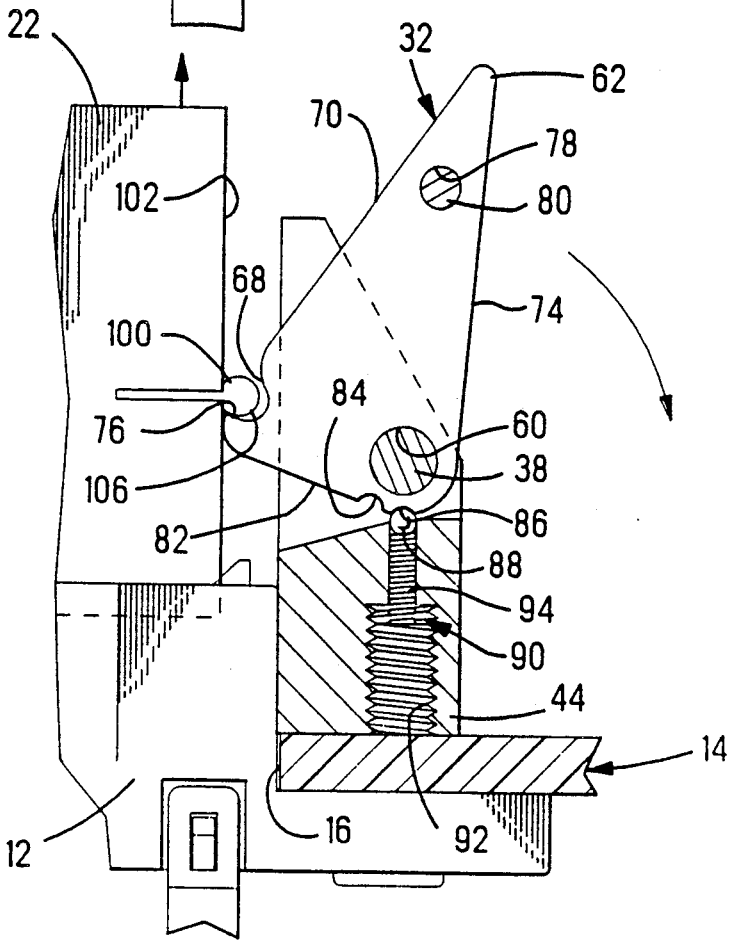

Referring to FIGS. 4B and 5B, actuation of a selected cam lever 34 or cam lever unit 68 can be performed after locking plates 40 are removed from both retention/ejection assemblies 30,32 along both sides 26,28 of the array. Selected cam lever 34 can then be rotated about shaft 38 outwardly away from the plug module 22 desired to be ejected and removed. Lower surface 76 of recess 68 engages downwardly facing surface 106 of projection 100 to push projection 100 upwardly, forcing plug module 22 upwardly and ejecting it from receptacle connector 12. Thus cam levers 34 can eject a plug module 22 or multi-module unit at least far enough for more assured grasping thereof by hand or by a tool. Projection 100 may have a vertical dimension of about 0.200 inches between upper surface 104 and lower surface 106

As Can be seen in FIG. 5B, upper surface 72 of recess 68 is shaped to be vertical when cam lever 34 is rotated to its second or ejection position about shaft 38. This allows vertical movement of module 22 upwardly away from receptacle connector 12 upon ejection, and during module insertion permits receipt of projection 100 into recess 68 after which upper surface 72 will bear against upper projection surface 104 as cam lever 34 is rotated inwardly to urge module 22 downwardly for full mating with receptacle connector 12.

Figure 6:
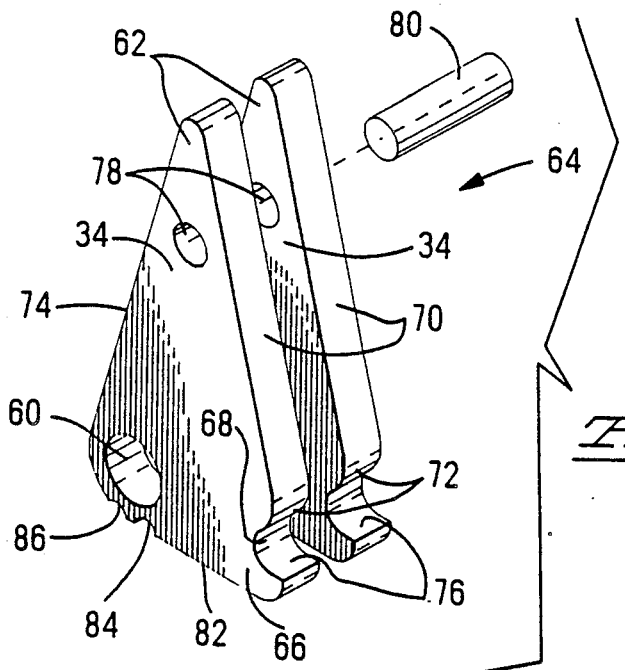
FIG. 6 is an enlarged isometric view of a pair of cam levers being secured together to act as a unit.

Referring to FIG. 6, a pin-receiving hole 78 extends through free end 62 so that a pin 80 of appropriate selected length may be inserted therethrough and through a pin-receiving hole 78 of one or more adjacent cam levers to gang them together as desired to comprise a multi-lever unit 64 maneuverable as a unit for actuation for ejection of a corresponding multi-module unit. As seen in FIGS. 5A, 5B and 6, along bottom surface 82 of each cam lever 34 are first and second ball-receiving recesses 84,86 both associated with a ball 88 of a ball detent assembly 90 threadedly assembled in an aperture 92 of base member 44 of each retention/ejection assembly 30,32. Each ball detent assembly 90 includes a compression spring 94 biasing ball 88 upwardly against bottom surface 82 of cam lever 34. First recess 84 defines a first or retention position for cam lever 34 at which position cam lever 34 secures or retains a corresponding plug module 22 mated within receptacle connector 12. Second recess 86 defines an actuated position achieved by rotating cam lever 34 outwardly to eject plug module 22, and which acts to stop further unnecessary and undesired rotation. As one pair of cam lever 34 or cam lever units are rotated apart to eject a selected plug module or multi-module unit, the ball detent arrangement of the remaining cam levers retain them in their first or retention positions, thus maintaining their associated plug modules or multi-module units fully mated, since locking plate 40 has been temporarily removed to eject the selected plug module.

Figure 7:
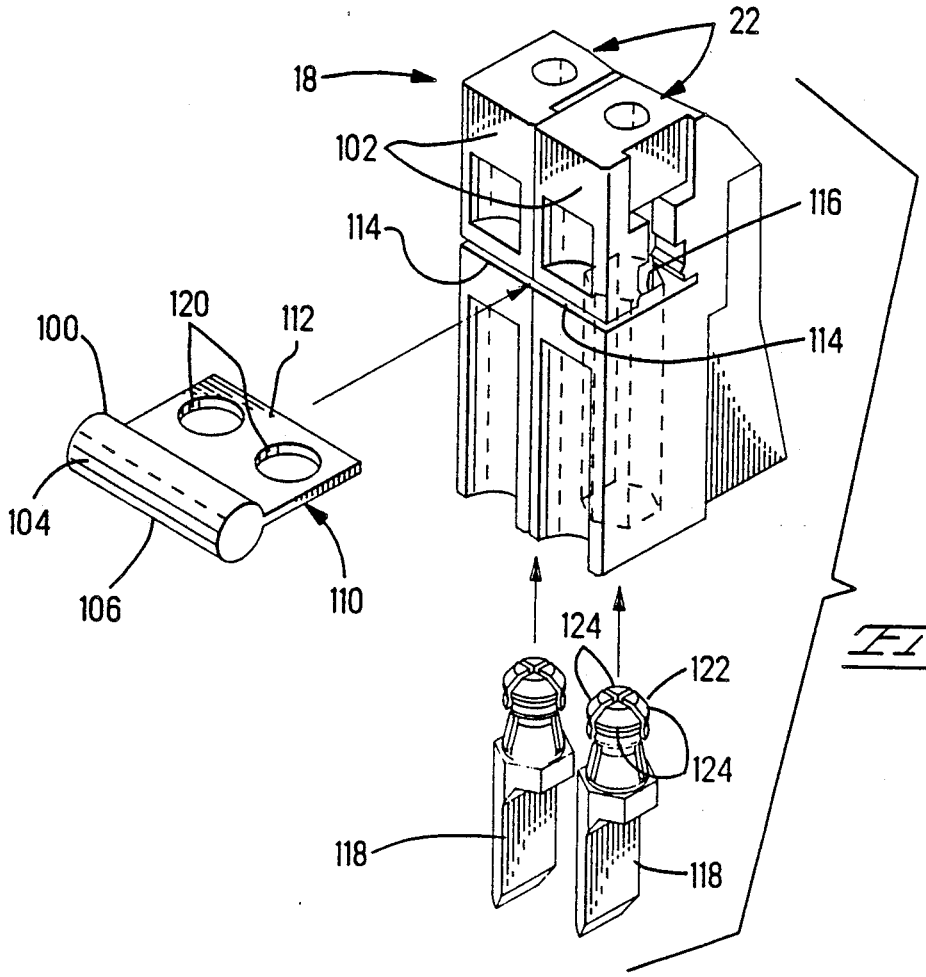
FIG. 7 is an enlarged isometric view of a module-ganging member being mounted to sides of a pair of plug modules.

In FIG. 7 plug modules 22 may be ganged together by a ganging member 110 secured to each side 102; ganging member 110 easily can include a cylindrical boss to define retention projection 100, whereby the several plug modules may be handled, retained and ejected as a unit. Ganging member 110 is shown having a length to secure together two plug modules 22 to define a two-module unit 18. Ganging member 110 includes an inwardly extending section 112, with boss 100 formed to extend along an outer edge. Inwardly extending section 112 is received into a horizontal slot 114 into each plug module 22 of unit 18, and horizontal slot 114 intersects key-receiving aperture 116 extending inwardly from the mating face of the plug module within which a key member 118 is disposed. Section 112 includes a pair of apertures 120 each aligned with a respective key-receiving aperture 116 of each module 22 when fully inserted into slot 114. Key member 118 as shown is self-retaining in an appropriate angular orientation for keying purposes with a cooperable with a corresponding key member of the receptacle connector as disclosed in U.S. Pat. No. 4,778,411; rearward end 122 of key member 118 comprises inwardly deflectable quadrant sections 124.

For assembly of ganging member 110 to plug modules 22 in FIG. 7, ganging member 110 is first placed appropriately within a slot 114 so that apertures 120 are aligned with and intersect key-receiving apertures 116 of modules 22. Then key members 118 are inserted fully into respective key-receiving apertures 116 of module 22 with rearward ends 122 extending through respective apertures 120 of ganging member 110, thus simultaneously securing key member 118 in module 22 and securing module 22 to ganging member 110. Preferably ganging members 110 are made of metal such as stainless steel for durability.

Various modifications may be devised to adapt the present invention to particular situations or plug modules or receptacle connectors of slightly different design, which are within the spirit of the invention and the scope of the claims.

What is claimed is:

1. A system for releasably retaining a plurality of modules in an array on a panel, comprising:

a pair of opposing assemblies secured to a panel at an array site, each assembly including at least a base member mounted against and along a surface of said panel, and each base member including a plurality of flange sections extending upwardly having aligned holes extending therethrough along which a shaft member is secured proximate said panel surface;

an array of cam lever members mounted in spaced relationship along said shaft member at each site of a module, said cam lever members each including a shaft-receiving aperture and coextending from said shaft member extending therethrough and away from said panel surface to respective free ends and reciprocally rotatably movable about said shaft member in a direction toward and away from the other said assembly, said cam lever members of both said assemblies being associated in opposing pairs at a said module site, and each said cam lever free end being adapted to be manually engaged to be rotated toward and away from the opposing said assembly between outward and inward positions;

each said cam lever member of each said pair including means for retaining a module in cooperation with retention means of said module laterally therealong when a said module is positioned in said array adjacent and between said pair of cam lever members and said cam lever members of said pair are rotated to respective said inward positions, with said retaining means and said module retention means cooperating to retain said module in said fully mated condition; and each said cam lever member of each said pair including a means for ejecting a module in cooperation with ejection means of a said module when said cam lever members of said pair are rotated to respective said outward positions, whereby a said module is retainable in said array by a pair of opposing cam levers independently of other modules separate therefrom in said array and is easily removable from said array while other said cam lever members retain said other separate modules in said array, and is retainable by means alongside said modules and needing only limited height, and said array of modules is retainable adjacent said panel among a plurality of like adjacent arrays, eliminating the need for additional framework and facilitating access to said modules.

2. A system as set forth in claim 1 wherein said cam lever free ends are aligned in a common row and at least two adjacent ones of said cam lever free ends include means secured thereto and therebetween joining said adjacent cam lever free ends such that said thus-joined cam levers are rotatable outwardly and inwardly about said shaft as a unit from side portions of at least two adjacent ones of said modules similarly ganged together to be manipulated as a unit, whereby only one said cam lever need be engaged to rotate both said adjacent cam lever free ends simultaneously.

3. A system as set forth in claim 1 wherein a locking member is securable to ends of flanges of said base member along outwardly facing surfaces of said cam levers of each said assembly to assuredly retain all said cam levers in their respective first positions retaining said modules in fully mated relationship with respective said receptacle connectors of said array.

4. A system as set forth in claim 1 wherein said base members are secured to bracket members mounted to said panel.

5. A system as set forth in claim 1 wherein spacer means are mounted on said shaft members at selected locations between adjacent ones of said cam levers, spacing certain ones of said cam levers apart to coincide with spacing of adjacent ones of said modules in said array.

6. A system as set forth in claim 1 wherein said retention means is an upper surface of a recess of said cam lever and said cooperable retention means is an upper surface of a projection from a side of a said module.

7. A system as set forth in claim,!2 wherein said ejection means is a lower surface of said recess of said cam lever and said cooperable retention means is a lower surface of said projection of said module.

8. A system as set forth in claim 1 wherein said cam lever includes detent means in cooperation with cooperating detent means of said base member defining first and second positions angularly about said shaft, whereby an opposed pair of said cam levers in said first position retain a said module and in said second position eject said module respectively.

9. A system as set forth in claim 8 wherein said cam lever detent means comprise first and second recesses along a lower surface proximate said shaft-receiving aperture, and said base member cooperating detent means comprise a ball detent assembly secured in said base member at each said cam lever adjacent and spring loaded against said lower surface to be receivable in said first and second recesses when said cam lever is rotated to said first and second positions.

10. A system as set forth in claim 1 wherein said shaft members extend through aligned holes in upwardly extending flanges at least at ends of respective said base members and through said aligned shaft-receiving apertures of said cam levers of each said assembly.

11. A system as set forth in claim 10 wherein end members are securable to aligned ends of said base members of said opposed assemblies to secure said shaft members in said aligned holes of said base member flanges of respective said base members.

* * * * *